United States Patent [19]

Wallace

[11] 4,439,993

[45] Apr. 3, 1984

[54] WIDE ISLAND AIR DEFROST CASE UTILIZING AIR TRANSFER CIRCULATING MEANS

[75] Inventor: George E. Wallace, Levittown, Pa.

[73] Assignee: Emhart Industries, Inc., Farmington, Conn.

[21] Appl. No.: 463,082

[22] Filed: Feb. 2, 1983

[51] Int. Cl.[3] ..... A47F 3/04

[52] U.S. Cl. ..... 62/82; 62/256

[58] Field of Search ..... 62/256, 282, 82

[56] References Cited

U.S. PATENT DOCUMENTS

| | | | |
|---|---|---|---|
| 4,182,130 | 1/1980 | Ljung | 62/82 |
| 4,267,706 | 5/1981 | Abraham | 62/256 |
| 4,285,204 | 8/1981 | Vana | 62/282 |
| 4,304,098 | 12/1981 | Rydahl | 62/82 |
| 4,314,457 | 2/1982 | Ibrahim | 62/256 |
| 4,337,626 | 7/1982 | Ibrahim | 62/82 |

*Primary Examiner*—William E. Wayner
*Assistant Examiner*—J. Sollecito
*Attorney, Agent, or Firm*—Frederick A. Zoda; John J. Kane

[57] ABSTRACT

A refrigerated display case of the wide island type having side-by-side, upwardly opening product display wells, uses its primary air circulating fans and a defrost fan to draw ambient air into the inlet and outlet of the air conduit of one product well, circulate it through the conduit of that well, transfer it to the air conduit of the second well, circulate it through the second conduit, and discharge it to atmosphere through the inlet and outlet of the second conduit. The case incorporates a solid center partition having an opening near the bottom of the case in which the defrost fan is mounted to transfer the air from one product well to the other. A splitter panel and sill at the upper end of the partition prevent the intake air from becoming mixed with the exhausted air. During a defrost cycle the air can be drawn into the first well and exhausted from the second well for the full duration of the cycle. Or, part way through the cycle a complete reversal of air flow can be effected so as to now draw the air into the second well and exhaust it from the first well for the remainder of the defrost cycle.

25 Claims, 5 Drawing Figures

WIDE ISLAND AIR DEFROST CASE UTILIZING AIR TRANSFER CIRCULATING MEANS

BACKGROUND OF THE INVENTION

1. Field Of The Invention

The present invention relates generally to refrigeration. In a more particular sense, the invention has reference to refrigerated display cases of the type used in food markets. In yet a more specific sense, the invention is a refrigerated display case of the so-called "wide island" category, in which side-by-side product display wells are separated by an upstanding partition that extends longitudinally and centrally of the case, with both wells being uncovered and opening upwardly to provide ready access to the displayed products.

2. Description Of The Prior Art

Refrigerated display cases of the type referred to above require frequent defrosting. To this end, many defrosting arrangements have been utilized in the art. One of these is air defrost. A case utilizing this defrost means draws ambient air into the conduits or air passages through which refrigerated air is circulated during refrigeration cycles. The relatively warm ambient air, when circulated through the conduits, melts the frost that has accumulated on the conduit walls and even more importantly on the evaporator coils, until ultimately the conduits and coils are completely clear of frost and are ready for resumption of the refrigeration cycle.

While air defrost can advantageously be employed in many types of cases, it has certain disadvantages as compared to other defrost arrangements. For example, hot gas defrost is widely used, and is highly efficient in that it accomplishes complete defrost in a relatively short time. Hot gas defrost, however, involves additional piping and valving, and requires special attention to the pressures developed in different areas of the system. Electrical defrost is also well known, utilizing electrical heating elements to melt the frost from the evaporators. The electrical energy requirements of this type of defrost, however, are high.

Considerable efforts, accordingly, have been made to develop efficient air defrost systems for refrigerated display cases, which require no additional piping or valving, and which add only minimally to the normal electrical energy requirements of the case.

Air defrost systems, however, have their own peculiar set of problems, and these problems can vary from one type of case to another. In a wide island case, for example, it is common to design the case for merchandising frozen food along one side of the case, in one product well, and ice cream in the product well at the other side. In such instances, the temperature requirements at the opposite sides of the case differ. Accordingly, during a refrigeration cycle it is important to keep the air circulating around one product well at a given temperature, while maintaining the circulating air of the other product well at a different temperature. Intermixing of the air circulated about one well with the air circulating about the other well, during a refrigeration cycle, should understandably be held to a minimum.

Yet, despite the obvious desirability of preventing commingling of the air flow patterns during refrigeration in wide island cases of the type described, there are strong reasons for defrosting both wells simultaneously and, of course, in the shortest possible amount of time. For example, one reason for simultaneously defrosting both sides of the case is that if one side is maintained in refrigeration while the other side is in defrost, heat exchange between the two sides would adversely affect both the refrigeration of the first side and the defrost of the second side. In any event, the prior art as exemplified by such patents as U.S. Pat. No. 4,314,457 and 4,337,626 both to Ibrahim; 4,304,098 to Rydahl; and 4,182,130 to Ljung, all disclose one or another of two types of wide island cases: (a) "unitized" cases in which there is a center flue that is common to both sides so that both sides must carry the same products to be refrigerated to the same temperature, with the air being intermixed both during refrigeration and defrost; or (b) cases in which the air flows at opposite sides are kept separate both during refrigeration and defrost.

Accordingly, it is desirable that if possible, in a wide island case having a partition down the center rather than a common center flue, and adapted for maintaining different refrigerating temperatures at the respective, opposite sides of the partition, there should be an air defrost system which will, during defrost and only during defrost, draw defrost air from the ambient atmosphere and circulate it through the conduit of one side, and then transfer it to the other side of the case, for circulation through the conduit and evaporator thereof, and then exhaust it back to atmosphere from the conduit of said other side of the case. The present invention has as its main purpose the provision of such a system.

SUMMARY OF THE INVENTION

Summarized briefly, the refrigerated display case of the present invention is of the type in which side-by-side product wells are separated by a vertical, solid partition extending longitudinally and centrally of the case structure. The partition, at the bottom of the case, has an opening which provides communication between the air conduit of the product well at one side of the partition, and the air conduit of the product well at the other side thereof. In the opening a defrost fan is mounted, with its axis perpendicular to the vertical plane of the partition, and with its blades lying in and rotating in said plane. Each product well has a primary conduit extending continuously around the bottom and both sides of the upwardly opening product well. An inlet and outlet are provided at the upper ends of the respective sides of the conduit of each well, so that during refrigeration air circulated through the conduit flows directly across the open top of the product well. In the conduit of each product well there is provided the usual evaporator and circulating fan.

In accordance with the invention, during refrigeration the defrost fan is idle. The primary circulating fans of the respective wells are on and operate in a normal forward direction at this time, so as to circulate refrigerated air through the respective evaporators and across the open tops of the product wells. When the air is circulated in this way, it does not flow through the communicating opening provided at the bottom of the partition, so that the refrigerating systems are in effect separately maintained, thus permitting the refrigerated air of one product well to be maintained at a temperature different from that of the other well, if desired.

During defrost, the defrost fan is operated, the primary fan of one product well continues to operate in a normal forward direction, and the primary fan of the other well is reversed. As a result, at the side having the reversely operating primary fan, ambient air is drawn into both the inlet and outlet of the primary conduit, flowing through both sides and the bottom thereof. This air is transferred by the defrost fan to the second side of the case, where the primary fan has continued to operate in a normal forward direction. In the conduit of the second side of the case, the air is circulated through both sides and across the bottom, and is exhausted from both the inlet and outlet of said second conduit.

If desired, to equalize the defrost time of both sides, after the defrost cycle has continued for a selected period of time, all the fans can be simultaneously reversed. Thus, for the duration of the defrost cycle, the conduit at one side of the partition that was the air intake conduit during the first stage of the defrost becomes the exhaust conduit, while the conduit at the other side is changed over from being an air exhaust to an air intake conduit.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
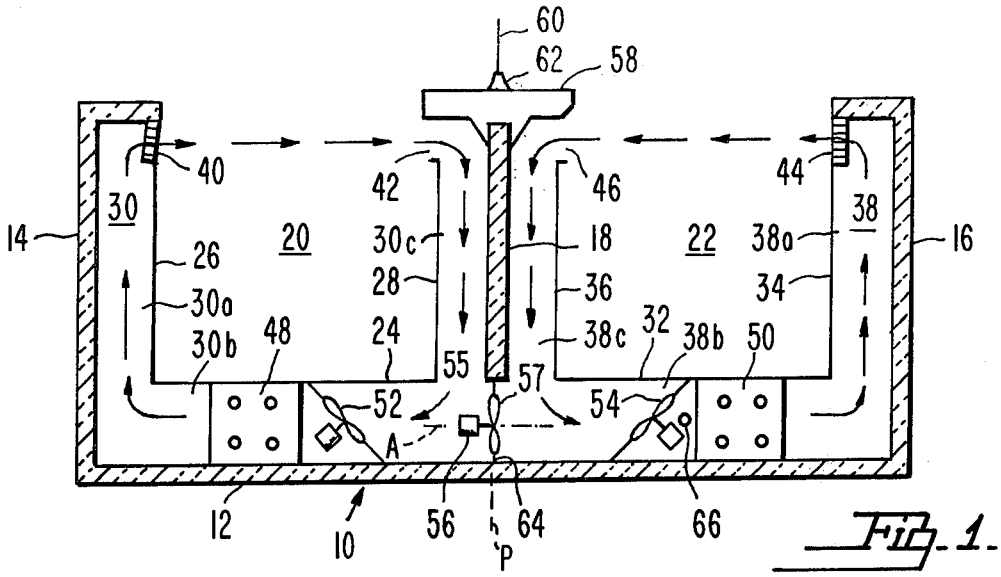
FIG. 1 is a transverse sectional view of a wide island case during a normal refrigeration cycle.

Designated generally at 10 is a wide island case, including an insulated bottom wall 12 common to both sides of the case and extending across the full width of the case. Extending upwardly from the bottom wall are insulated first and second side walls 14, 16 respectively, cooperating with a vertical, insulated center partition or divider 18 in defining, at opposite sides of the partition, first and second, side-by-side product display wells 20, 22 respectively that open upwardly to provide ready access to the products displayed therein.

Display well 20 includes a bottom air conduit wall 24, and outer and inner air conduit walls 26, 28 respectively. Walls 24, 26, 28 are spaced inwardly of the case from the walls 12, 14, 18 respectively to define a continuous air conduit 30 extending around the bottom and both sides of the product display area of well 20. In cross section, the air conduit 30 is generally U-shaped, having an outer side duct portion **30*a*, a bottom duct portion 30*b*, and an inner side duct portion 30*c*. Generally vertical duct portions 30*a*, 30*c* extend upwardly from and are in continuous communication with the generally horizontal bottom duct portion 30*b***.

Product well 22 is similarly constructed at the other side of partition 18. Thus, it includes a bottom conduit wall 32, and upstanding outer and inner conduit side walls 34, 36 respectively. Walls 32, 34 and 36 are spaced inwardly from walls 12, 16, 18 respectively, to form a conduit 38 about the display area of well 22, said conduit extending continuously across the bottom and up both sides of said display area and having an outer side duct portion **38*a*, a bottom duct portion 38*b*, and an inner duct portion 38*c*. At the upper ends of duct portions 30*a* and 30*c* there are provided an air outlet 40 and an air inlet 42, respectively. Similarly, an outlet 44 and an inlet 46 are provided at the upper ends of the duct portions 38*a*, 38*c*, with the several outlets 40, 42, 44, 46 all being disposed in approximately a common horizontal plane perpendicular to a vertical plane P (see FIG. 1) of partition 18**.

Within the conduits 30, 38 there are provided evaporator coils 48, 50 respectively and primary circulating fans 52, 54 respectively.

At the bottom of the case, partition 18 is formed with an opening 55. Mounted in this opening is a defrost fan 56, the axis A of which (FIG. 1) lies perpendicular to the plane P of partition 18, with the blades 57 of the fan rotating in the plane of the partition.

At the upper end of the partition there is provided a sill 58 which extends the length of the display case, and which is symmetrically formed and arranged in respect to the plane P. The sill projects laterally outwardly in opposite directions from the partition, overlying the air inlets 42, 46 of the respective primary conduits 30, 38. Above the sill, an air splitter panel 60, which may have a base 62 to facilitate mounting of the panel on the sill, extends upwardly above the open tops of the display wells.

It is understood that the sill 58, panel 60, and base 62 of the panel, can be utilized for photographic displays and pricing information, and for lighting purposes, in addition to performing certain functions, to be explained hereinafter, during the defrost cycle.

The air flow patterns developed during a refrigeration cycle are shown in FIG. 1. In the case illustrated by way of example, in each well the circulating fan, during refrigeration, causes flow along the bottom conduit portion through the evaporator in a direction from the center of the case to the outer side, with the flow then being directed upwardly within the outer conduit portions **30*a*, 38*a*, respectively. The refrigerated air is discharged through the outlets 40, 44, in a direction from the outer side of each access opening, across the access opening toward the center of the case, and then into the inlets 42, 46 respectively. The return air passes through the inner side portions 30*c*, 38*c* of the respective conduits, back to the bottom portions 30*b*, 38*b***.

The flow around each product well is maintained separately from the flow of the other product well. Although there is an opening 55 at the bottom of partition 18, air does not flow through said opening during the refrigeration cycle, since the defrost fan 57 is idle, and each of the fans 52, 54 turn outwardly all air that exits from the inner side portions **30*c*, 38*c* of the conduits 30, 38** respectively.

Although the air, during the refrigeration cycle, travels from the outer side to the inner side of the case across the top of each display well, the normal flow during a refrigeration cycle could be in the opposite direction, that is, in some wide island cases the openings 42, 46 are the outlets and the openings 40, 44 are the inlets.

At this point, it may be noted that the wells 20, 22 could, as previously indicated herein, contain products to be refrigerated at different temperatures. For example, well 20 could be a frozen food area, and well 22 could be a display area for ice cream. These would be maintained at different temperatures, and no problem is presented in accomplishing this since the opposite display wells are separated by a solid, insulated partition 18. In a typical installation, these two different types of foods are often marketed at opposite sides of a wide island case, and since the temperatures at which these products are maintained are not too far apart, no problem is presented by heat transfer through the defrost fan 57 and its mounting plate 64, during refrigeration of both sides.

Figure 2:
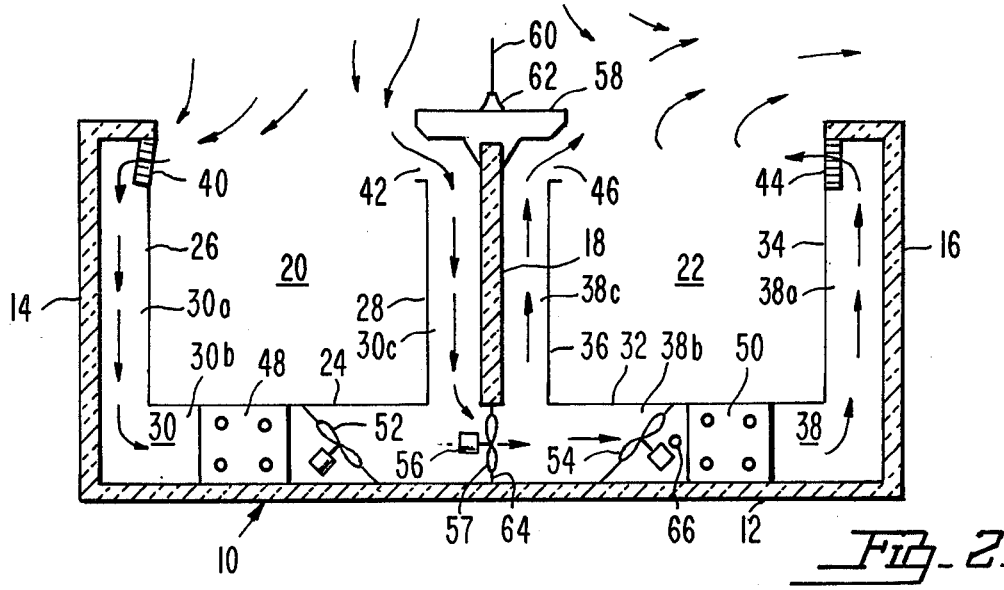
FIG. 2 is a similar view of the case, during defrost.

When a defrost cycle is initiated, refrigeration of the coils 48, 50 is terminated, fan 52 is reversed, defrost fan 56 is turned on and operates to force air from left to right viewing the same as in FIG. 2, while the other primary fan 54 remains on in its normal direction.

In these circumstances, ambient air is drawn into conduit 30 of display well 20, from the area above the well 20. Fan 52, which is now forcing air to the right in FIG. 2, pulls ambient air downwardly, through outlet 40, said air passing downwardly through outer conduit portion 30*a*, and thereafter flowing within conduit portion 30*b* through coil 48 to defrost the same.

At the same time, defrost fan 57, which is selected to move a greater volume of air in a given amount of time than fan 52, pulls air downwardly from the ambient atmosphere above well 20 through the inlet 42. This air passes downwardly through conduit portion 30*c* and along with the air pulled into the conduit by fan 52, is forced by fan 57 through the communicating opening 55 between the opposite sides of the case, into the conduit 38. Fan moves a greater volume of air in a given amount of time than fan 54, so that some of the air transferred by fan 57 is forced upwardly within conduit portion 38*c*, exiting through the inlet 46. The remaining air transferred by fan 57 to conduit 38 is forced by fan 54 through the coil 50, and upwardly through conduit portion 38*a*, exiting through outlet 44. The air forced through outlet 44 and inlet 46 meets above the well 22, and is directed upwardly and outwardly over the outer side wall thereof.

The panel 60 and sill 58 cooperate in preventing commingling of the ambient air drawn into the conduit 30, with the cooler air exhausted from the conduit 38. Sill 58, as will be noted, deflects the incoming air laterally outwardly, to assure that fresh ambient air is drawn into the conduit 30, and in particular to the inner side portion 30*c* thereof. Sill 58, being symmetrically formed and arranged in respect to the plane of the partition 18, also deflects laterally outwardly the air exhausted from the conduit 38, in particular the inner side portion 38*c* thereof. Thus, the fresh incoming air and the used defrost air are widely separated by the sill 58. Splitter panel 60, meanwhile, assures still further, in cooperation with the sill, that there will be no commingling of the fresh, incoming ambient air and the cooler, exhausted air, so that the incoming and outgoing air currents are completely separated and do not interfere with each other's flow patterns.

Figure 4:
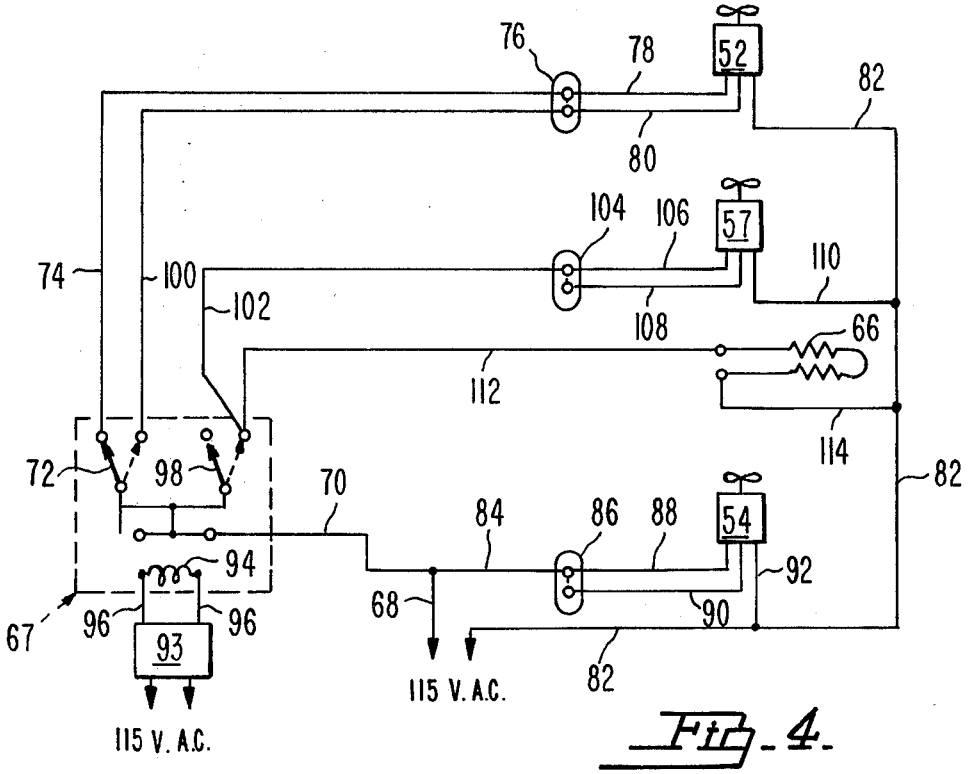
FIG. 4 is a simplified schematic view of the electrical circuitry utilized for controlling the fan operation, during the single-stage defrost cycle illustrated in FIG. 2; anc
Figure 5:
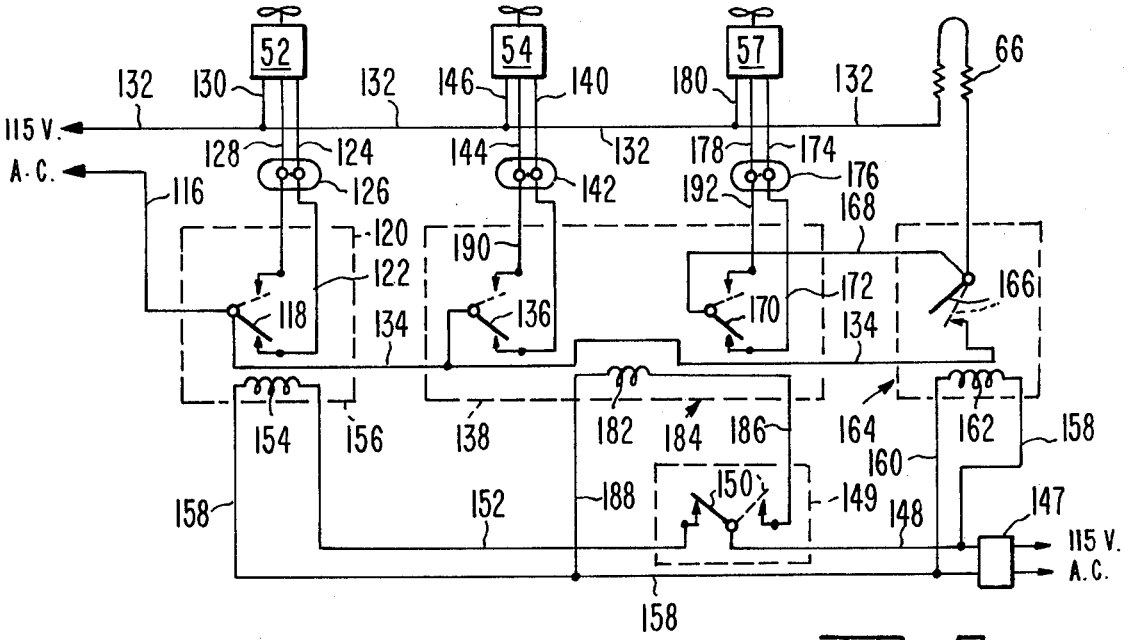
FIG. 5 is a schematic view of the circuitry used for the two-stage defrost cycle illustrated in FIGS. 2 and 3.

FIGS. 4 and 5 show the electrical circuitry used as a means for controlling the fan operation. In FIG. 4 there is shown a circuit that would be used in installations in which the single stage defrost cycle (FIG. 2 only) is sufficient, considering the temperatures at which the opposite sides of the case are to be maintained, and such other factors as the humidity and temperature of the store environment in which the equipment is installed.

Figure 3:
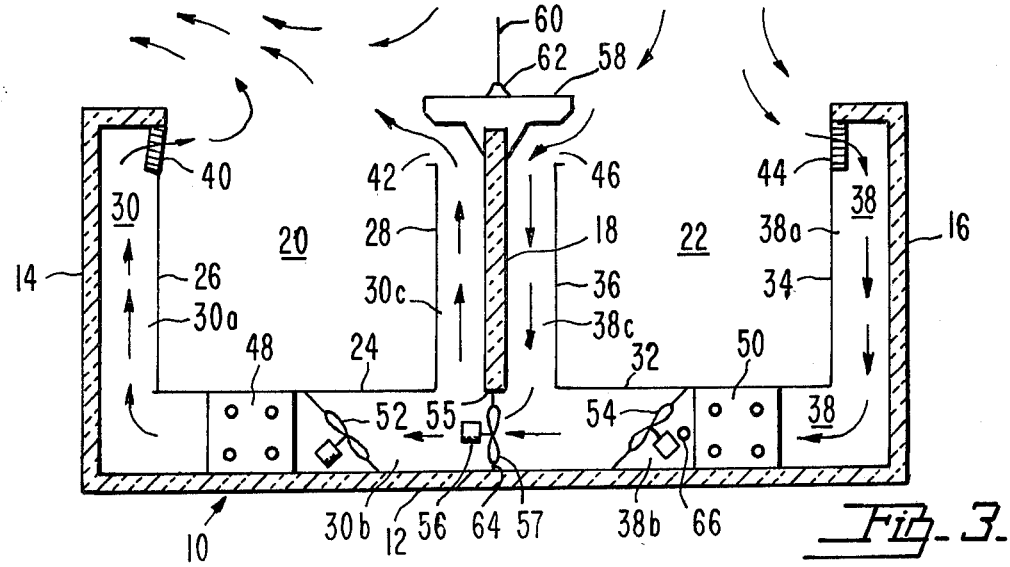
FIG. 3 is a similar view during an optional second stage of the defrost in which all the fans have been reversed.

FIG. 5 illustrates the circuitry that would be employed in those installations in which it is found desirable to utilize the two-stage defrost cycle of FIGS. 2 and 3, in which, in the first stage, the fans are operated in the direction shown in FIG. 2; and in the second stage, are operated in the directions shown in FIG. 3 until defrost is completed.

Whether the single-stage or the two-stage defrost cycle is used, it may be desirable to incorporate a supplemental heating element 66 for operation during defrost in, for example, the side of the case that is normally maintained at a lower temperature during normal refrigeration. This element is shown in close proximity to coil 50 in the illustrated example. It could be located elsewhere, or if desired there could be another heating element in proximity to coil 48. Or, the use of supplemental heating elements can be omitted entirely in some installations. Should, however, the element be used, it could be electrically connected in the circuitry shown in FIGS. 4 and 5 without difficulty.

Referring to FIG. 4, the movable contacts of a relay 67 are shown in full lines in their normal position as they would be during refrigeration, and in dotted lines in the positions to which they shift during the defrost cycle shown in FIG. 2. Electrical current flows from a suitable power source as follows: leads 68, 70, contact 72 of de-energized relay 67, lead 74, capacitor 76, leads 78, 80 extending from the capacitor to the parallel windings of primary fan 52 which is of the permanent split capacitor motor type, and return to the power source through lead 82.

Current also flows through lead 68, lead 84, capacitor 86, capacitor motor leads 88, 90, primary fan 54 (which is of the same type as fan 52), and return through leads 92, 82.

Defrost would be initiated either by a timer 93, or if the system utilizes demand rather than timed defrost by a frost sensing device, not shown. In any event, when defrost is initiated, power is supplied to the winding 94 of relay 67 through leads 96 extending from the timer or other defrost-initiating device. This operates relay contacts 72, 98 to their dotted line positions. Power will flow through lead 100 to capacitor 76, and leads 78, 80 to the motor of fan 52. When fan 52 was in normal operation, current flowed directly through leads 74, 78 to one winding of the motor, while being forced through the capacitor and lead 80 to the other winding. For reversing the motor, current from the power source flows directly through lead 100 and lead 80 to the second winding of the motor, while flowing through the capacitor and lead 78 to the first winding, causing reversal of the fan.

Meanwhile, fan 54 operates in its normal forward direction, since the current flow to the windings thereof remains as it was during refrigeration.

During the defrost cycle of FIG. 2, current also flows through leads 68, 70, relay contact 98, lead 102, motor lead 106, capacitor 104, and motor lead 108, to operate the motor of defrost fan 56 with the power returning to the source through leads 110, 82. The shifting of switch contact 98 to the dotted line position responsive to energizing of relay winding 94 also energizes heating element 66 through the provision of leads 112, 114.

If it is desired to utilize a two-stage defrost cycle with the FIG. 2 arrangement being the first stage and the FIG. 3 arrangement being the second, the circuitry shown in FIG. 5 is employed. In this circuitry, again the movable contacts are shown in full lines as they appear during refrigeration, and in dotted lines during the defrost stages. During refrigeration, current flows as follows: lead 116, movable contact 118 of relay 120, lead 122, and lead 124 to a first winding of primary fan 52. Current also flows through capacitor 126, and lead 128 to the second winding of fan 52. Return to the source of power is through leads 130, 132.

Primary fan 54 is similarly energized, by current flowing through lead 134, movable contact 136 of relay 138, and lead 140 to one winding of motor 54. Current also flows through capacitor 142 to lead 144 extending to the other winding of fan 54 and back to the source of power through leads 146, 132.

At the initiation of defrost, the closing of contacts on a timer 147, or on a frost sensing defrost initiating means (not shown) close, causing power to flow through lead 148, contact 150, lead 152, the winding 154 of relay 156, and back through lead 158 to the source of power to which the winding 154 is connected by the now closed contacts of the timer. As a result, movable contact 118 is shifted to the dotted line position thereof shown in FIG. 5, so that current flows through lead 116, contact 118, and lead 128 to the second winding of motor 52, and also through capacitor 126 and lead 124 to the first winding of the motor, causing the primary fan 52 to be reversed as shown in FIG. 2. Return to the source of power is through leads 130, 132.

Current also flows through the motor 54, which operates in its normal forward direction during the first stage of defrost shown in FIG. 2, with current flowing through leads 116, 134, contact 136, capacitor 142, and leads 140 and 144, motor 54, lead 146, and lead 132 back to the source of power.

Closing of the contacts on the timer also energize, through leads 158, 160 connected to leads 148, 158 respectively, the winding 162 of a relay 164. As a result, current will flow through leads 116, 134, contact 166 which will have been moved to its dotted line position by energizing of winding 162, heating element 66, and back to the source of power through lead 132.

Current will also flow through leads 116, 134, contact 166, lead 168, contact 170, lead 172, lead 174 to the first winding of defrost fan 56, and also through capacitor 176 and lead 178 to the second winding of fan 57, with return through leads 180, 132.

When the defrost is to go into its second stage, the timer remains on. A second timer 149 can at this time operate contact 150 to the dotted line position in FIG. 5. Timer 149 could if desired be combined with the primary or main timer 147, as a second contact means 150 thereof. The means 150 would in this event be closed by the main timer after a predetermined period of time following initiation of the first defrost stage. Or, instead, the device 150 could be a thermostatic device used to initiate the second stage of defrost. A predetermined rise in temperature at a selected location in the case would then be utilized to operate the contact 150 to the dotted line position. Whether a timer or a thermostat is used, in these circumstances the circuit through winding 154 is opened by movement of contact 150 to the dotted line position, so that switch contact 118 reverts to the full line position thereof, causing primary fan 52 to revert to its normal forward operating direction, with current flowing therethrough as described above in the discussion of the refrigerating cycle. At this time, however, a coil 182 of relay 184 is energized, by current flowing through lead 148, contact 150, lead 186, coil 182, lead 188, and lead 158. This operates contacts 136, 170 to the dotted line positions thereof. As a result, the direction of the other primary fan 54 is reversed, by current flowing through leads 116, 134, 136, 190, and lead 144, and by current flowing from lead 190 through capacitor 142 and lead 140.

Current also flows through the heater element in the second stage, and in addition the direction of the defrost fan 56 is reversed, by current flowing through leads 116, 134, contact 166, lead 168, contact 170, lead 192, and lead 178 to one winding of the defrost fan, with current also flowing through lead 192, capacitor 176, and lead 174 to the other winding of the fan 56. Return to the power source is through leads 180, 132.

As a result, in the second stage the direction of all the fans is reversed, with primary fan 52 reverting to the normal forward direction, primary fan 54 being reversed, and defrost fan 56 also being reversed.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, the improvement wherein:

a. the conduits have a communicating opening formed in the partition near the bottom of the case;
b. a defrost fan is mounted in the communicating opening to transfer air from one conduit to the other;
c. at least one of the primary fans is reversible;
d. during refrigeration both primary fans are on and operate in a normal forward direction and the defrost fan is off; and
e. during defrost said one primary fan is reversed, the defrost fan is on, and the other primary fan is on and operates in a normal forward direction, to draw ambient air through both the inlet and outlet of said one conduit and exhaust it through the inlet and outlet of the other conduit.

2. In a wide island refrigerated display case the improvement of claim 1, said partition lying in a vertical plane, wherein the defrost fan is mounted to direct air through said communicating opening along a path normal to said plane.

3. In a wide island refrigerated display case the improvement of claim 2 in which the fan axis extends perpendicularly to said plane.

4. In a wide island refrigerated display case the improvement of claim 3 wherein said conduits have generally horizontal bottom portions extending at opposite sides of said communicating opening in the path along which air is directed by the defrost fan.

5. In a wide island refrigerated display case the improvement of claim 4, said bottom portions of the conduits being aligned with the axis of the defrost fan.

6. In a wide island refrigerated display case the improvement of claim 2, said conduits having generally vertical inner side portions located at opposite sides of and separated throughout their lengths by said partition.

7. In a wide island refrigerated display case the improvement of claim 6, and said partition being solidly formed fully from the communicating opening to its upper end.

8. In a wide island refrigerated display case the improvement of claim 6, said case including a sill at the upper end of the partition extending laterally outwardly in opposite directions from the plane of the partition above the inner side portions of the conduits to deflect the air that is to be drawn into said one conduit, and the air that is to be exhausted from the other conduit, laterally outwardly from the plane of the partition at opposite sides thereof to minimize commingling thereof.

9. In a wide island refrigerated display case the improvement of claim 8 in which the sill is symmetrically formed and arranged in respect to the plane of the partition.

10. In a wide island refrigerated display case the improvement of claim 6, said case further including an air splitter panel extending above the tops of the wells to minimize commingling of air drawn into the conduits with the air exhausted therefrom.

11.In a wide island refrigerated display case the improvement of claim 8, further including an air splitter panel lying in the plane of the partition and extending upwardly from the sill to cooperate therewith in preventing air drawn into said one conduit from mixing with air exhausted from the other conduit.

12. In a wide island refrigerated display case the improvement of claim 11, the several inlets and outlets of the conduits lying approximately in a common horizontal plane, the sill and splitter panel being disposed wholly above said common horizontal plane of the inlets and outlets.

13. In a wide island refrigerated display case the improvement of claim 8, said inlets and outlets of the respective conduits lying approximately in a common horizontal plane and the sill being disposed wholly above said plane.

14. In a wide island refrigerated display case the improvement of claim 1 wherein all of said fans are of the reversible type, and means for changing the operating modes thereof at a selected time after initiation but before completion of defrost, whereby the defrost fan remains on but operates in a reverse direction to transfer air from said other conduit to said one conduit, said one primary fan reverts to operation in a normal forward direction, and said other primary fan remains on but operates in a reversed mode.

15. In a wide island refrigerated display case the improvement of claim 14 wherein said means is effective to require that the fans operate in their changed operating modes until defrost is completed.

16. A method of defrosting a wide island refrigerated display case of the type through which air is circulated during both refrigeration and defrost, said case having side-by-side, upwardly opening product wells separated by a central partition, said wells including primary conduits respectively disposed at opposite sides of the partition, the partition having an opening providing communication between the conduits, each conduit having opposite side duct portions in communication with a bottom duct portion, each partition having an inlet and an outlet at the upper ends of the side duct portions thereof for directing air across the open tops of the wells during refrigerating cycles of the display case, evaporators within the conduits, and primary fans in the conduits for circulating air therethrough, comprising the steps of:

a. drawing ambient defrost air into one of the conduits through both the inlet and the outlet thereof;
b. directing said defrost air through the side and bottom duct portions of said one conduit;
c. after the defrost air has passed through the several duct portions of said one conduit, forcibly transferring the defrost air through said opening into the other conduit for passage therethrough;
d. directing the transferred air through the bottom and side duct portions of said other conduit; and
e. returning the defrost air to ambient atmosphere from said other conduit through both the inlet and outlet thereof.

17. A method of defrosting a wide island refrigerated display case as in claim 16 further comprising the step of effecting the forcible transfer of air between the conduits in the area of the bottom of the case, at the lower end of the partition.

18. A method of defrosting a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, comprising the steps of:

a. drawing ambient air into one of the conduits for passage therethrough; and
b. exhausting said air from the other conduit, wherein the step of drawing ambient air into the case comprises drawing the air into both the inlet and outlet of said one conduit.

19. A method of defrosting a wide island refrigerated display case of the type through which air is circulated during both refrigeration and defrost, said case having side-by-side, upwardly opening product wells including primary conduits each having an inlet and an outlet for directing air across the open tops of the wells, evaporators within the conduits, and primary fans in the conduits for circulating air therethrough, comprising the steps of:

a. drawing ambient air into one of the conduits for passage therethrough; and
b. exhausting said air from the other conduit, wherein the step of exhausting air from the case comprises exhausting said air from both the inlet and the outlet of said other conduit.

20. A method of defrosting a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, comprising the steps of:

a. drawing ambient air into one of the conduits for passage therethrough; and
b. exhausting said air from the other conduit, wherein the steps of drawing ambient air into the case and exhausting the air therefrom comprise drawing the incoming air through both the inlet and the outlet of said one conduit, and exhausting the outgoing air through both the inlet and the outlet of the other conduit.

21. A method of defrosting a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, comprising the steps of:

a. drawing ambient air into one of the conduits for passage therethrough; and b. exhausting said air from the other conduit, and further comprising the steps of, during defrost, simultaneously operating one primary fan in a normal forward direction, reversing the other primary fan, and forcibly transferring air from the conduit containing the forwardly operated fan to the conduit containing the fan operated in a reverse direction.

22. A method of defrosting a wide island refrigerated display case as in claim 21 further comprising the step, at a selected time after initiation of defrost, of simultaneously changing the operating modes of the several fans to operate said one primary fan in reverse, operate said other primary fan in a forward direction, and reversing the direction in which air is being transferred between the conduits.

23. A method of defrosting a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, comprising the steps of:

a. drawing ambient air into one of the conduits for passage therethrough; and b. exhausting said air from the other conduit, and further comprising the step, at a selected time after initiation of defrost, of reversing the direction of all the air that is in passage through the conduits so as to exhaust air from said one conduit while drawing air into said other conduit.

24. A method of defrosting a wide island refrigerated display case as in claim 23 further comprising: maintaining the reversed direction of all the air in passage through the conduits until defrost is completed.

25. In a wide island refrigerated display case of the type through which air is circulated during both refrigeration and defrost, said case having side-by-side, upwardly opening product wells separated by a central partition, said wells including primary conduits each having an inlet and an outlet for directing air across the open tops of the wells, evaporators within the conduits, and primary fans in the conduits for circulating air therethrough, the improvement wherein:

a. the conduits have a communicating opening formed in the partition near the bottom of the case;

b. a defrost fan is mounted in the communicating opening to transfer air from one conduit to the other;

c. at least one of the primary fans is reversible;

d. during refrigeration both primary fans are on and operate in a normal forward direction and the defrost fan is off; and e. during defrost said one primary fan is reversed, the defrost fan is on, and the other primary fan is on and operates in a normal forward direction, to draw ambient air through both the inlet and outlet of said one conduit and exhaust it through the inlet and outlet of the other conduit, the defrost fan having a greater volumetric capacity than the respective primary fans.

* * * * *

UNITED STATES PATENT AND TRADEMARK OFFICE

CERTIFICATE OF CORRECTION

PATENT NO. : 4,439,993

DATED : April 3, 1984

INVENTOR(S) : George Everett Wallace

It is certified that error appears in the above-identified patent and that said Letters Patent are hereby corrected as shown below:

Column 3, Line 35, change "anc" to -- and --

Column 5, Line 31, after "Fan" insert -- 56 --

Signed and Sealed this

*Second* Day of *October 1984*

[SEAL]

*Attest:*

GERALD J. MOSSINGHOFF

*Attesting Officer*

*Commissioner of Patents and Trademarks*